United States Patent [19]

Peterson

[11] 4,295,544

[45] Oct. 20, 1981

[54] PLATFORM STEPLADDER

[76] Inventor: Donald J. Peterson, 2727 E. Fifth Ave., Knoxville, Tenn. 37914

[21] Appl. No.: 145,475

[22] Filed: May 1, 1980

[51] Int. Cl.[3] ..... E06C 7/18; E06C 1/383

[52] U.S. Cl. ..... 182/106; 182/104; 182/118

[58] Field of Search ..... 182/106, 104, 118, 116, 182/165–177, 24, 25

[56] References Cited

U.S. PATENT DOCUMENTS

| | | | |
|---|---|---|---|
| 109,256 | 11/1870 | Schachtel | 182/126 |
| 351,713 | 10/1886 | Pursel et al. | 182/165 |
| 1,425,274 | 8/1922 | Parkinson | 182/126 |
| 1,439,419 | 12/1922 | Jacobs | 182/106 |
| 1,572,008 | 2/1926 | Hall | 182/165 |
| 1,644,856 | 10/1927 | Reed | 182/165 |
| 2,126,805 | 8/1938 | Parkinson | 182/126 |
| 2,208,833 | 7/1940 | Brimboeuf | 182/106 |
| 2,467,800 | 4/1949 | Backlin | 182/106 |
| 2,507,396 | 5/1950 | Boggs | 182/106 |
| 2,533,391 | 12/1950 | Miller | 182/106 |
| 2,640,641 | 6/1953 | Tepper | 182/106 |
| 3,112,010 | 11/1963 | Mihalik | 182/106 |
| 3,500,957 | 3/1970 | Stern | 182/104 |

*Primary Examiner*—Reinaldo P. Machado
*Attorney, Agent, or Firm*—Luedeka & Fitch

[57] ABSTRACT

A stepladder comprises a pair of front legs pivotally attached to a forward platform and a pair of rear legs pivotally attached to a rear platform. The front platform and rear platform are hingedly attached to one another for movement between a coplanar position and a folded position. The front legs are releasably locked in a position perpendicular to the front platform. The rear legs are releasably locked to said rear platform at an angle of about 110°. A support member is pivotally attached to the front legs to extend perpendicularly upwardly from the front platform.

3 Claims, 5 Drawing Figures

PLATFORM STEPLADDER

The present invention relates to ladders and more particularly to folding step ladders which include platforms.

There are at least two features of a folding step ladder which are quite important to the user: stability in use, particularly at the upper levels, and compactness for storage and transportation. Unfortunately, in the case of most folding step ladders, these features are contrary to one another.

For stability, as well as comfort, a wide platform is far more desirable than a rung or step. A platform permits a user to shift his feet without fear of stepping off the ladder. However, large, comfortable platforms create storage problems. A ladder which provides a typical user to reach to a height of about twelve feet includes a standing area at a height of about five feet. In order to provide a platform at a height of about five feet, the overall height of such ladders must be substantially greater than five feet. This is unfortunate because a ladder which is substantially greater than five feet in length is both difficult to carry and will not fit into most automobiles for transportation. While the overall height can be reduced for transportation or storage by telescoping or hinging each leg, such connections frequently create stability problems. As the ladder is used repeatedly, the hinged or telescoping connections gradually become worn. As a result, such ladders wobble and provide less security for the user.

Efforts have been made to provide folding support rails for step ladders so that a user can safely stand on the top step of the ladder. However, the prior support rails have required the ladder to be spaced from the work area. Thus, the user is required to lean out from the ladder, applying constant pressure to the support rail and varying the center of gravity. The safety problems arising from such an arrangement are quite apparent.

It is therefore an object of the present invention to provide a ladder which is compact for transportation and storage. It is also an object to provide a ladder which, when extended, provides a large, stable platform at a height which is generally equivalent to the length of the ladder in the folded position and which is positionable immediately adjacent to the work area. It is a further object to provide a ladder which includes a handrail for additional stability in the extended position, yet which is easy to adjust and does not reduce the effective size of the platform. Other objects and advantages will be recognized from the following description, including the drawings in which:

The ladder described herein generally comprises a pair of front leg members hingedly attached to a forward platform member, a pair of rear leg members hingedly attached to a rear platform member. The front platform member and rear platform member are hingedly attached to one another for movement between a coplanar position and a collapsed angular position. Means are provided for releasably locking the front leg members in a position perpendicualr to the front platform member. Means are also provided for releasably locking the rear leg members in a position forming an obtuse angle with the rear platform member. A generally U-shaped support member is pivotally attached to the front leg members and means are provided for securing the support member in a fixed position generally perpendicular to the front platform member.

Figure 1:
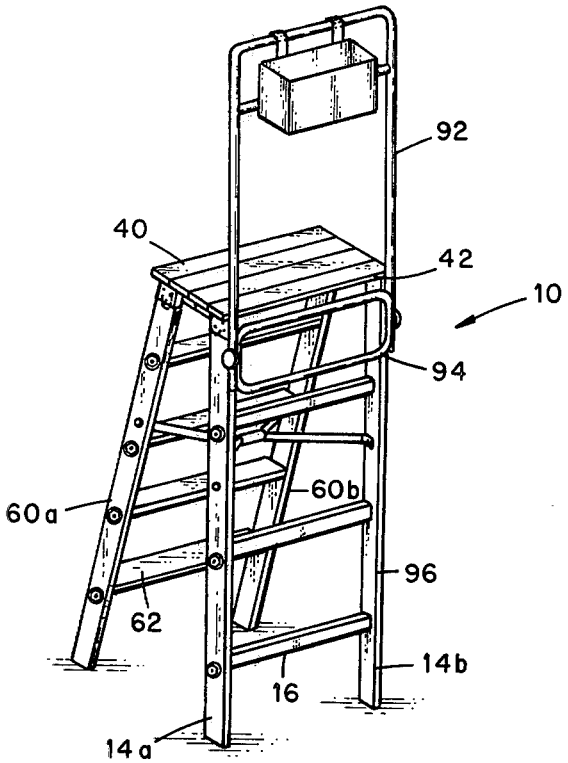
FIG. 1 is a perspective view of a ladder embodying various of the features of the present invention.

Referring more specifically to the drawings, the ladder 10 shown in FIG. 1 includes a front leg assembly 12 which includes a pair of elongated leg members 14*a* and 14*b*. Each of the legs 14*a* and 14*b* is four feet, eleven inches in length and 2.5 inches by 0.875 inch in cross-section. The legs 14*a* and 14*b* are connected to one another in a parallel orientation by means of three crossbars 16 and three tie rods 18. Each crossbar 16 is notched into both legs 14*a* and 14*b*, perpendicular to the legs 14*a* and 14*b* and at equally spaced intervals along the legs. A tie rod 18, comprising a 0.25 inch diameter, threaded steel rod extends through each of the legs 14*a* and 14*b* immediately below each of the crossbars 16. At each end 20 of each tie rod 18, a washer 22 and nut 24 are threadably attached to prevent the legs 14*a* and 14*b* from spreading apart. As the ladder 10 is used, repeated pressure may eventually cause loosening of the notched joints between the crossbars 16 and the legs 14*a* and 14*b*. The threaded tie rods 18 and nuts 24 permit the legs 14*a* and 14*b* to be resecured with the crossbars 16 as necessary. The washers 22 prevent the nuts 24 from wearing into the legs 14*a* and 14*b*.

At the upper end 26 of each leg member 14*a* and 14*b*, a steel sleeve 28 is secured by means of a plurality of screws 30. Each sleeve 28 includes two parallel extension portions 32 which extend beyond the top of leg 14*a* or 14*b*. Two spaced-apart apertures, a front aperture 34 and a rear aperture 36 are defined in each extension portion 32, the apertures of each extension portion being in register with the apertures of the other extension portion of the respective sleeve 28.

A front platform 38 is hingedly attached to the front leg assembly 12. The front platform 38 comprises two coplanar boards 40 and includes a forward edge 42 and a rear edge 44. The platform 38 is seven inches between the forward edge 42 and the rear edge 44. The boards 40 are secured to two spaced-apart cross members 46 by screws, for example. The cross members 46 are parallel to one another and perpendicular to the longitudinal axes of the boards 40. Each cross member 46 is adapted for passing between the extension portions 32 of a sleeve 28 and defines a pair of spaced-apart apertures, a front aperture (not shown) and a rear aperture 48. The front and rear apertures of each member 46 are spaced apart by a distance which is equivalent to the spacing between the apertures 34 and 36 of the extension portions 32 of the sleeves 28, so that the front apertures and rear apertures are in register simultaneously.

A pivot pin 50 is permanently inserted through the front apertures of each sleeve 28 and the respective cross member 46 to hingedly attach the front leg assembly 12 to the front platform 38. In order to releasably lock the front platform 38 in a position perpendicular to the legs 14*a* and 14*b*, a cotter pin 52 is connected to the sleeve 28 by means of a flexible member 54, such as sash chain. The pin 52 is adapted for sliding insertion through the rear apertures 36 and 48, which are in register when the front platform 38 is in the desired perpendicular position.

The depicted ladder 10 also includes a rear leg assembly 56 which is hingedly attached to a rear platform 58. The rear leg assembly 56 includes a pair of elongated leg members 60*a* and 60*b*, each of which is five feet, 2.5 inches in length and 2.5 inches by 0.875 inch in cross-section. The legs 60*a* and 60*b* are connected to one another in a parallel orientation by means of four steps 62 and four tie rods 64. Each step 62 is three inches wide and nineteen inches long. Each step is notched into both legs 60*a* and 60*b*, perpendicular to the legs 60*a* and 60*b* and at equally spaced intervals along the legs. A tie rod 64, comprising a 0.25 inch diameter threaded steel rod extends through each of the legs 60*a* and 60*b* immediately below and in contact with each of the steps 62. At each end 66 of each tie rod 64, a washer 22 and nut 24 are threadably attached to prevent the legs 60*a* and 60*b* from spreading and to reinforce the steps 62. As noted hereinabove, the tie rods 64 also permit the legs 60*a* and 60*b* to be resecured in case the notched joints become loosened with extensive use.

Each of the leg members 60*a* and 60*b*, defines a parallelogram, i.e., the top and bottom surfaces form angles of 70° with the longitudinal axis of the respective leg member. At the upper end of each leg member 60*a* and 60*b*, a steel trapezoidal sleeve 68 is secured by means of screws 30. Each sleeve 68 includes two parallel extension portions 70 which extend beyond the top surface of the respective leg. Two spaced-apart apertures, a front aperture 72 and a rear aperture (not shown), are defined in each extension portion 70, the apertures of each extension portion 70 being in register with the apertures of the other extension portion of the respective sleeve 68.

The rear platform 58 is hingedly attached to the rear leg assembly. Like the front platform 38, the rear platform comprises two coplanar boards 40 and includes a forward edge 74 and a rear edge 76. The boards 40 are secured to two spaced apart cross members 78 by screws for example. The cross members 78 are parallel to one another and perpendicular to the longitudinal axes of the boards 40. Each cross member 78 is adapted for passing between the extension portions 70 of a sleeve 68 and defines a pair of spaced apart apertures, a front aperture 80 and a rear aperture (not shown). The apertures defined in each cross-member 78 are spaced apart by a distance which is equivalent to the spacing between the apertures defined in the extension portions 70 of the sleeves 68.

A pivot pin 82 is permanently inserted through the rear apertures of each sleeve 68 and the respective cross member 78 to hingedly attach the rear leg assembly 56 to the rear platform 58. In order to releasably lock the rear platform 58 in a position in which the legs 60*a* and 60*b* each define an obtuse angle of 110° with the platform 58, a cotter pin 86 is connected to the sleeve 68 by means of a flexible member 88, such as sash chain. The pin 86 is adapted for sliding insertion through the front apertures 72 and 80 when the rear platform 58 is in the desired position.

The front platform 38 and rear platform 58 are hingedly attached to one another by means of two hinges 90 so that the rear edge 44 of the front platform 38 and the forward edge 74 of the rear platform 58 are located adjacent to one another.

Figure 2:
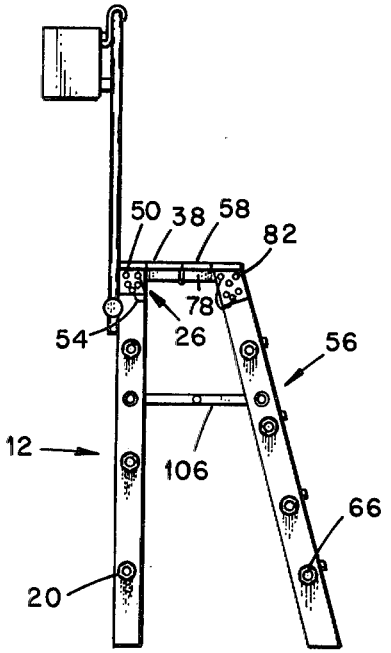
FIG. 2 is a side elevational view of the ladder shown in FIG. 1.

A generally U-shaped support member 92 is pivotally secured to the front leg assembly 12 for motion between a folded position (FIG. 3) and an upright position (FIG. 2). Means are provided for releasably locking the member 92 in either the folded position or the upright position. The releasable locking means includes a tubular, generally rectangular member 94 which is fixedly attached to the front surfaces 96 of the sleeves 28, by screws for example. The member 94 provides cylindrical side sections 98. At the mid point of each side section an aperture is defined, extending entirely through each side section 98 and adapted to receive a threaded bolt 100 which extends outwardly from the member 94.

At each end of the U-shaped support member 92, a hemi-cylindrical portion 102 is removed to define a cradle section adapted to matingly receive a cylindrical side section 98. The support member is thus pivotable 180° between two secure positions in which the side sections 98 fully engage the cradle sections 102, i.e., the folded position shown in FIG. 3 and the upright position shown in FIG. 2. A locking handle 104 is threadably mounted upon the bolt 100 to lock the support member 92 in either the folded or upright position, as desired.

A conventional X-shaped folding brace 106 interconnects the front legs 14*a* and 14*b* and the rear legs 60*a* and 60*b* to ensure that the legs are maintained at the desired spacing.

When the ladder 10 is in use, the leg assemblies 12 and 56 are spread apart, pivoting about the pins 50 and 82, respectively until the leg assembly 12 is perpendicular to the front platform 38 and the leg assembly 56 forms an obtuse angle of 110° with the rear platform 58. At this point, when the rear apertures 36 of the sleeves 28 are in register with the corresponding apertures of a cross member 46, the pins 52 are inserted to lock each front leg to the front platform. In addition, when the front apertures 72 of the sleeves 68 are in register with the corresponding apertures of the cross members 78, the pin 86 is inserted to lock each rear leg to the rear platform 58.

The front platform 38 and rear platform 58 are then pivoted about the hinges 90 until the platform sections are coplanar, at which point the brace 106 is extended to lock the rear edge 44 of the front platform against the front edge 74 of the rear platform.

The handles 104 are then threadably loosened to permit outward flexing of the legs of the U-shaped support member 92. Flexing of the support member 92 disengages the cradle sections 102 from the side sections 98, thus permitting rotation of the member 92 about the bolts 100. When the support member 92 is located in the upright position shown in FIG. 2, the member 92 is released and the cradle sections reengage the cylindrical side sections 98 and the handles 104 are tightened into engagement with the cradle sections.

As shown in FIGS. 1 and 2, a box may be suspended from the member by means of S-hooks, for example. Such an arrangement is particularly useful for maintaining paint buckets or tools in a convenient location.

Figure 3:
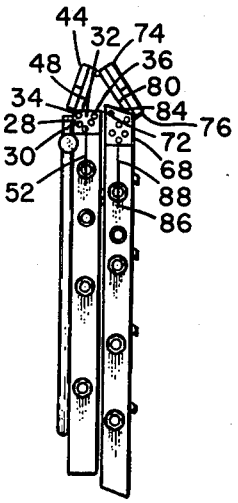
FIG. 3 is a side elevational view of a ladder embodying various of the features of the present invention in a folded condition.
Figure 4:
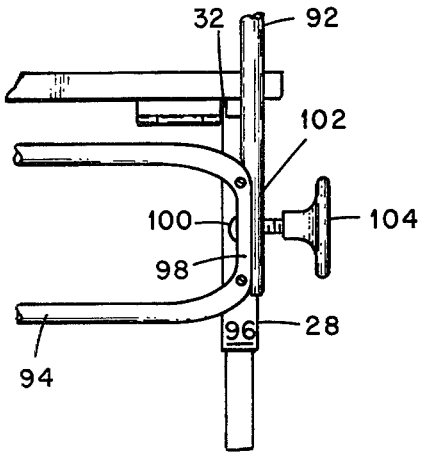
FIG. 4 is a fragmentary perspective view of the bottom of the platform of the ladder shown in FIG. 1.
Figure 5:
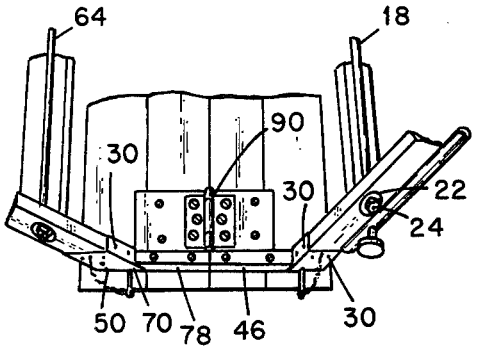
FIG. 5 is a fragmentary front elevational view of the ladder shown in FIG. 2.

When the above-described ladder is fully expanded a large standing area, approximately fourteen inches by twenty-three inches, is provided at a height of five feet. In addition, a support rail is provided at a level three feet above the platform for an operator to conveniently hold while using the ladder. The support member and the front legs are oriented perpendicular to the platform so that the entire platform is usable and the ladder may be placed immediately adjacent to a wall. Thus an operator can stand as close to the working area as desired, without leaning yet there is room to move around on the platform. The combination of the large platform and the support member provide a stable position for an operator. The locking pins ensure that the ladder will not fold up in use. After use, the ladder is foldable to a length which is not substantially greater than the height of the platform in use and a thickness comparable to the thickness of legs, as shown in FIG. 3.

While a preferred embodiment of the present invention has been defined with particularity herein, it will be understood that there is no intent to limit the invention by such disclosure, but rather, it is intended to cover all modifications and alternate constructions falling within the spirit and scope of the invention as defined in the appended claims.

I claim:

1. A stepladder comprising a pair of elongated front leg members pivotably attached to a front platform, a pair of elongated rear leg members pivotably attached to a rear platform, said front platform being hingedly attached to said rear platform for movement between a coplanar position and a folded position, means for releasably locking said front leg members to said front platform in a position generally perpendicular to said front platform, means for releasably locking said rear leg members to said rear platform in a position in which said rear leg members form an angle of about 110° with said rear platform, a support member pivotally attached to said front leg member and means for securing said support member in a fixed position extending generally perpendicularly upwardly from said front platform including a cylindrical section secured to one of said front legs and a hemi-cylindrical cradle section defined on said support member, adapted to receive said cylindrical section.

2. A ladder as defined in claim 1 wherein said locking means comprise cotter pins adapted for insertion through apertures defined in each of said leg members and apertures defined in each of said platforms.

3. A stepladder as defined in claim 1 wherein said support member is U-shaped.

* * * * *